US005398745A

United States Patent [19]

Cook

[11] Patent Number: 5,398,745

[45] Date of Patent: * Mar. 21, 1995

[54] METHOD OF DIRECTIONALLY COOLING USING A FLUID PRESSURE INDUCED THERMAL GRADIENT

[75] Inventor: Arnold J. Cook, Mt. Pleasant, Pa.

[73] Assignee: PCC Composites, Inc., Pittsburgh, Pa.

[ * ] Notice: The portion of the term of this patent subsequent to May 12, 2009 has been disclaimed.

[21] Appl. No.: 58,407

[22] Filed: May 7, 1993

[51] Int. Cl.[6] ..... B22D 27/04; B22D 18/00

[52] U.S. Cl. ..... 164/66.1; 164/120; 164/122.1; 164/97; 164/122.2

[58] Field of Search ..... 164/120, 122.1, 122.2, 164/66.1, 97

[56] References Cited

U.S. PATENT DOCUMENTS 3,420,291 1/1969 Chandley et al. ..... 164/120

5,111,870 5/1992 Cook ..... 164/97

FOREIGN PATENT DOCUMENTS 58-84662 5/1983 Japan ..... 164/120

*Primary Examiner*—Kuang Y. Lin

*Attorney, Agent, or Firm*—Ansel M. Schwartz

[57] ABSTRACT

The present invention is a method of cooling. The method comprises the steps of positioning material in a liquid state within a chamber. Then, there is the step of providing pressurized fluid about the chamber to form a thermal gradient across the chamber to directionally cool the material within. Preferably, the positioning step includes the step of positioning a mold with a mold chamber having material in a liquid state in the mold chamber, within an interior of a pressure vessel. Preferably, the providing step includes the step of introducing fluid, such as gas, into the pressure vessel such that the fluid that initially enters the pressure vessel is heated to a greater temperature than fluid subsequently introduced into the pressure vessel due to the fluid absorbing heat from the interior of the pressure vessel. The fluid at the greater temperature rises to the top of the pressure vessel and forces cooler fluid down so that a thermal gradient is formed in the pressure vessel such that the temperature of the fluid about the top of the mold allows the material within the top of the mold to remain at a higher temperature than the material within the bottom of the mold to induce directional cooling of the material in the mold from the bottom of the mold. For instance, a thermal gradient can be formed which allows the material in the top of the mold to remain molten while the material in the bottom of the mold directionally solidifies. The cooling of a casting in a pressurized environment drastically reduces the cooling time of the casting to room temperature. In a preferred embodiment, the step of introducing fluid into the pressure vessel can serve the dual purpose of forcing the liquid material into the mold chamber and forming the thermal gradient.

41 Claims, 6 Drawing Sheets

METHOD OF DIRECTIONALLY COOLING USING A FLUID PRESSURE INDUCED THERMAL GRADIENT

FIELD OF THE INVENTION

The present invention is related to a method for cooling a casting. More specifically, the present invention is related to a method for directionally solidifying a casting within a pressure vessel by forming a thermal gradient within a fluid, such as gas, in the pressure vessel.

BACKGROUND OF THE INVENTION

It is commonly known that directional solidification can enhance the structural properties of a cast part. Accordingly, it is desirable to cool a mold from one or several distinct locations. It is known in the prior art to cast materials, such as metals, within a pressure vessel. For instance, see U.S. Pat. No. 5,111,870. This method consists essentially of disposing a mold and a source of molten metal, within a mold. The vessel is then pressurized in a manner which forces the molten metal into the mold. It is also known in the past to effect directional solidification within the pressure vessel by thermally contacting the mold with a cooled member such as a chill plate. This is also shown in U.S. Pat. No. 5,111,870. However, there is no apparatus or method disclosed in the prior art which introduces a fluid, such as gas, into a pressure vessel such that a thermal gradient is formed within the gas and across the mold which causes directional solidification of the material within the mold. Casting methods such as hot isostatic pressing (HIP) do not induce a thermal gradient since the gas pressure and temperature are raised at the same time.

The formation of a thermal gradient is similar to the process of hot air rising in a room. Gas that initially enters the pressure vessel with a heated mold and after heating is terminated, is heated more than subsequently introduced gas and thus rises to the top of the pressure vessel while the cooler gas moves to the bottom of the pressure vessel. The cooler the gas is, the lower it is disposed in the vessel. In a room at 1 atmosphere pressure, a temperature gradient exists. Raising the gas pressure increases the temperature gradient. The higher the gas pressure, the higher is the gradient. One would expect the temperature would be more uniform with higher pressures due to increased conductivity, however, this is the opposite of what occurs.

SUMMARY OF THE INVENTION

The present invention is a method of directional cooling. The method comprises the steps of having material in a liquid state within a chamber and providing pressurized fluid about the chamber to form a thermal gradient across the chamber to directionally cool the material within. Preferably, the positioning step includes the step of disposing a mold with a mold chamber having material in a liquid state in the mold chamber, within an interior of a pressure vessel. Preferably, the providing step includes the step of introducing fluid, such as gas, into the pressure vessel such that the fluid that initially enters the pressure vessel is heated to a greater temperature than fluid subsequently introduced into the pressure vessel due to the fluid absorbing heat from the interior of the pressure vessel. The fluid at the greater temperature rises to the top of the pressure vessel and forces cooler fluid down so that a thermal gradient is formed in the pressure vessel such that the temperature of the fluid about the top of the mold allows the material within the top of the mold to remain at a higher temperature than the material within the bottom of the mold to induce directional cooling of the material in the mold from the bottom of the mold.

For instance, a thermal gradient can be formed which allows the material in the top of the mold to remain molten while the material in the bottom of the mold directionally solidifies. The cooling of a casting in a pressurized environment drastically reduces the cooling time of the casting to room temperature. For example, at 1000 psi, the pressure induces a relatively large thermal gradient. A casting can then be cooled to room temperature in 10 minutes. At room pressure, the same casting would take 10 hours to cool. In a vacuum, the same casting would take at least 24 hours to cool.

In a preferred embodiment, the step of introducing fluid into the pressure vessel can serve the dual purpose of forcing the liquid material into the mold chamber and forming the thermal gradient.

It should also be noted that the thermal gradient and directional solidification can be controlled by altering a variety of factors such as the rate of which the gas is introduced into the pressure vessel, the gas pressure, gas temperature, insulation, pressure vessel wall temperature and heat exchangers, such as chill members or heating elements, to name but a few of the factors that can be controlled. Circulating the gas can be used to reduce the thermal gradient or remove it completely. Given enough time, the gas will reach a uniform temperature at the room or the wall of the pressure vessel.

BRIEF DESCRIPTION OF THE DRAWINGS

In the accompanying drawings, the preferred embodiment of the invention and preferred methods of practicing the invention are illustrated in which.

FIGS. *2a–2d* are schematic representations of the pressure vessel and its interior during various stages of a method of casting of the present invention.

FIGS. *3a* and *3b* are cross sectional schematic representations showing a mold being filled with material in a liquid state remote from the pressure vessel and subsequent loading of the mold with liquid material into the pressure vessel.

Figure 4:
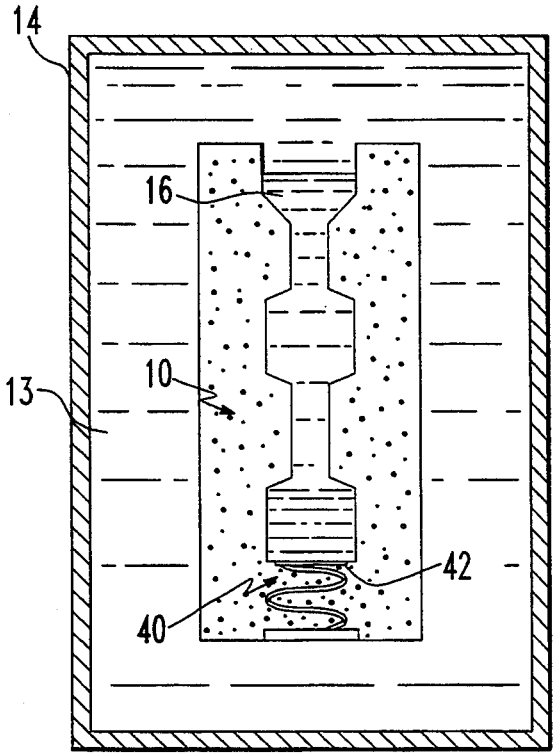

FIG. 4 is a cross sectional schematic representation of a mold having a crystal grain starter for single crystal formation.

Figure 5:
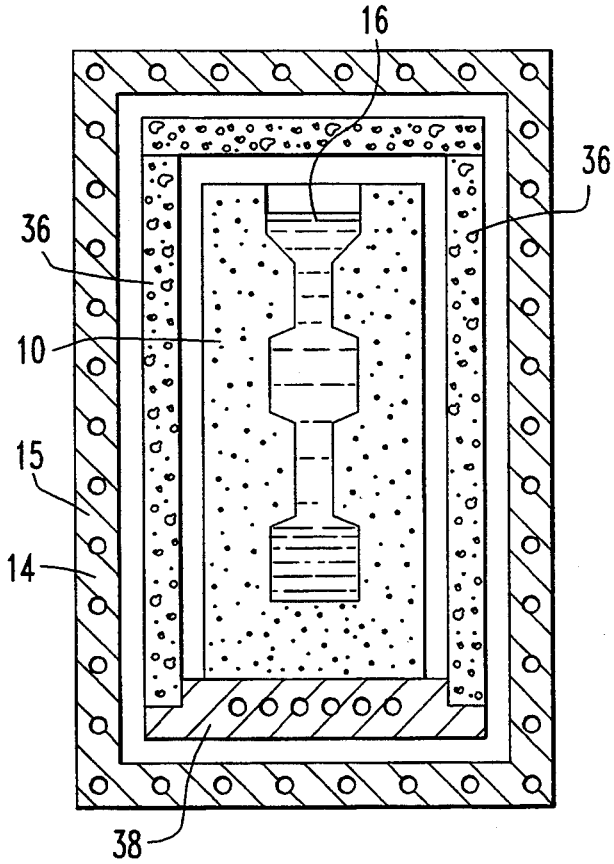

FIG. 5 is a cross sectional schematic representation of a water cooled pressure vessel having insulation and a chill member disposed about the mold to control cooling.

Figure 6:
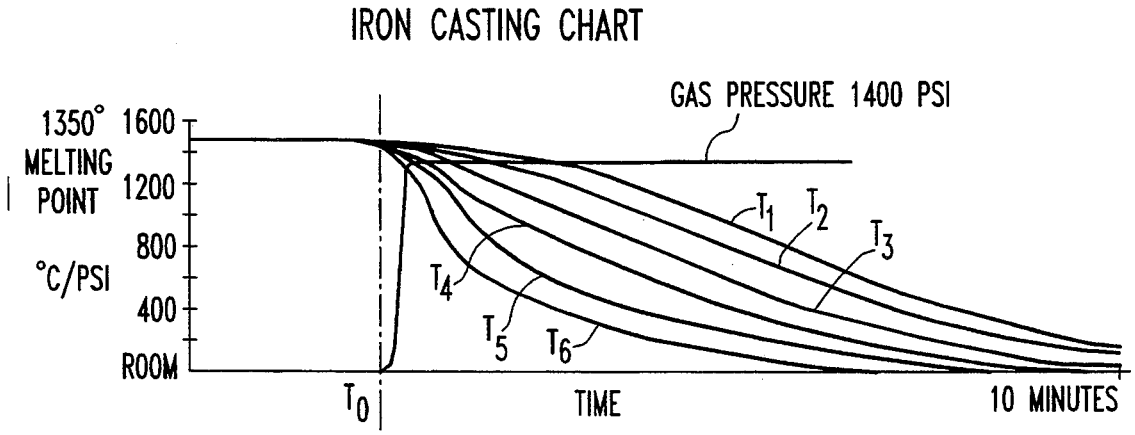

FIG. 6 is a chart showing temperature at different locations in the vessel and pressure vs. time during the casting of iron.

Figure 7:
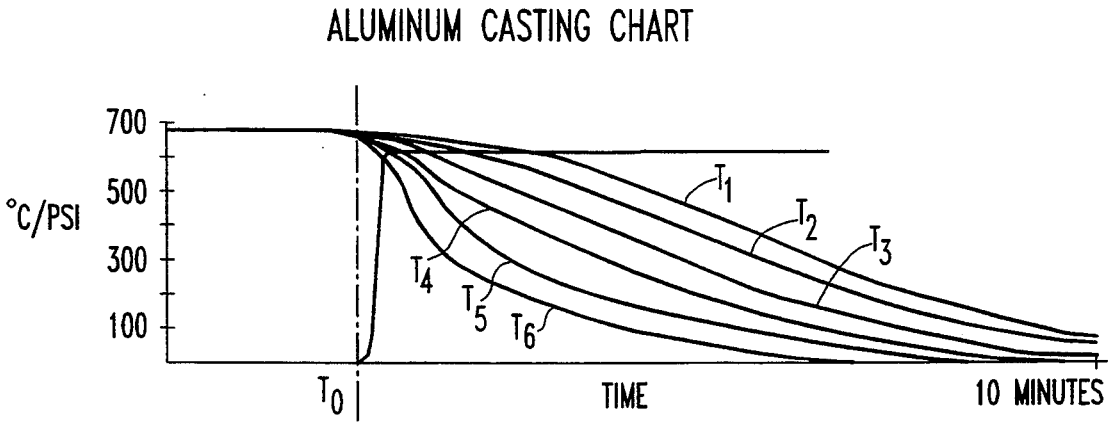

FIG. 7 is a chart showing temperature at different locations in the vessel and pressure vs. time during the casting of aluminum.

Figure 8:
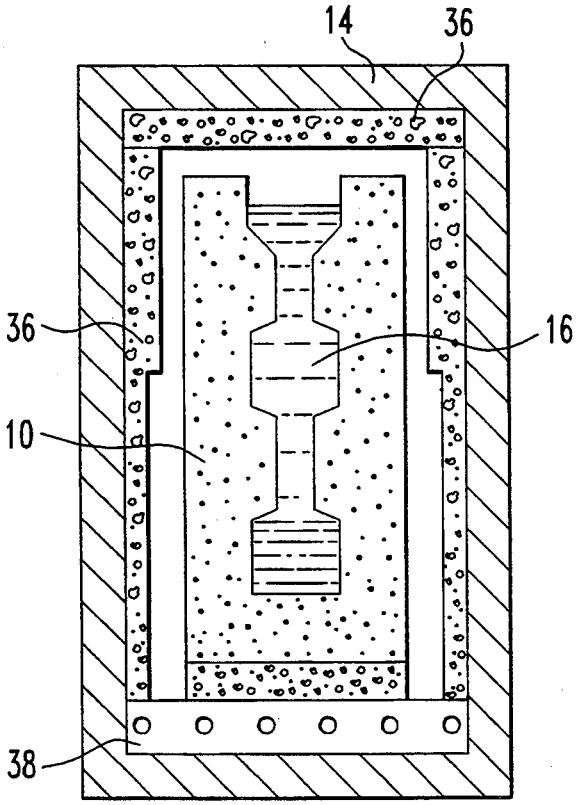

FIG. 8 is a cross sectional schematic representation showing a pressure vessel having insulation of varying thickness.

DESCRIPTION OF THE PREFERRED EMBODIMENT

Figure 1:
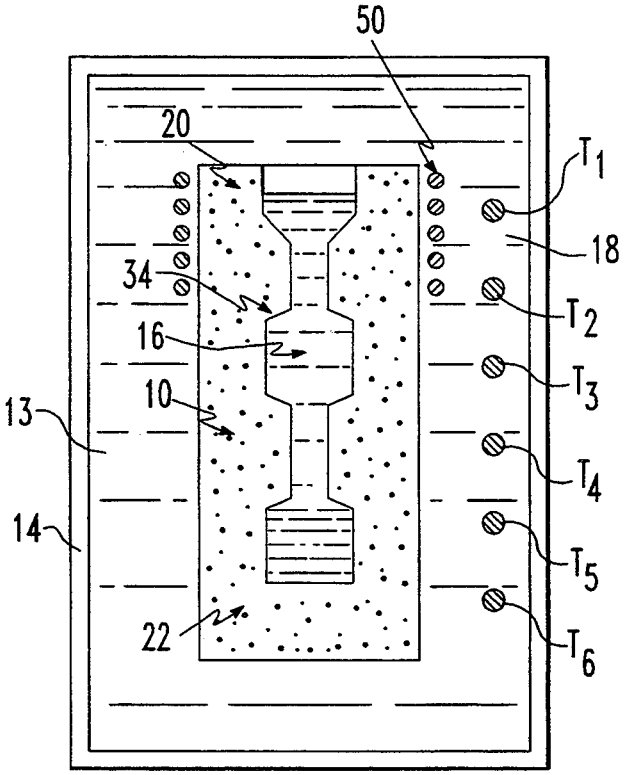
FIG. 1 is a cross sectional schematic representation of a pressure vessel and its interior in a method of casting of the present invention.

Referring now to the drawings wherein like reference numerals refer to similar or identical parts throughout the several views, and more specifically to FIG. 1 thereof, there is shown a method of directional cooling. The method comprises the step of positioning material 16 in a liquid state within a chamber 34. Then, there is the step of providing pressurized fluid about the chamber 34 to form a thermal gradient across the chamber 34 to directionally cool the material 16 within. Preferably, the positioning step includes the step of disposing a mold 10 with a mold chamber 34 having material 16 in a liquid state in the mold chamber 34, within an interior 13 of a pressure vessel 14. Preferably, the providing step includes the step of introducing fluid, for example gas, into the pressure vessel 14 such that the fluid that initially enters the pressure vessel 14 is heated to a greater temperature than fluid subsequently introduced into the pressure vessel 14, due to the fluid absorbing heat from the interior 13 of the pressure vessel 14 or items in the vessel. The fluid at the greater temperature rises to the top 18 of the pressure vessel 14 causing cooler fluid down so that a thermal gradient is formed in the pressure vessel 14 such that the temperature of the fluid about the top 20 of the mold 10 allows the material 16 within the top 20 of the mold 10 to remain at a higher temperature than the material within the bottom 22 of the mold to induce directional solidification and cooling of the material 22 in the mold 10 from the bottom 22 of the mold towards the top.

For instance, a thermal gradient can be formed which allows the material 16 in the top 18 of the mold 10 to remain molten while the material 16 in the bottom 22 of the mold directionally solidifies towards the top. Reference characters $T_1$–$T_6$ in FIG. 1 represent gradually increasing temperature values, with $T_l$ the highest temperature at the top 20 of the mold 10 and $T_6$ the lowest temperature at the bottom 22 of the mold 10.

The cooling of a casting in a pressurized environment drastically reduces the cooling time of the casting to room temperature. For instance, at 1000 psi, which induces a relatively large thermal gradient, a casting can be cooled to room temperature in 10 minutes. At room pressure, the same casting would take 10 hours to cool. In a vacuum, the casting would take at least 24 hours to cool.

In one embodiment, and as shown in FIGS. *3a* and *3b*, the disposing step includes the step of loading a mold 10 having material 16 in a liquid state into the interior 13 of the pressure vessel 14. Preferably, before the introducing step, there is the step of evacuating the interior 13 of the pressure vessel 14. If desired, after the disposing step, there can be the step of heating the top 20 of the mold 10, or the entire mold 10, such as with heating elements 50. In this manner, the thermal gradient is enhanced. Alternatively, as shown in FIG. *2a–2d*, the material 16 can be melted and introduced into the mold chamber 34 within the pressure vessel 14. In this embodiment, the disposing step can include the steps of placing material 16 and mold 10 within the pressure vessel 14 and heating the material 16 causing it to be liquid, such as with heating coils 26. Preferably, before the introducing step, there is the step of evacuating the interior 13 of the pressure vessel 14. Though it should be appreciated that this is not required.

If desired, before the introducing step, there can be the step of stopping the heat to the material 16. Alternatively, during the introducing step, there can be the step of heating only the top 20 of the mold or any point on the mold 10, such as with heating element 50, as shown in FIG. 1.

The fluid is preferably an inert gas such as nitrogen or argon, but is not limited thereto. The casted material 16 can be comprised of metal, plastic or ceramic but is not limited thereto. The mold 10 can be any of a variety of materials and construction. For instance, the mold 10 can be an investment mold or a permanent mold, but is not limited thereto.

The present invention also allows for the thermal gradient to be controlled in magnitude to suit the specific application. For instance, the thermal gradient can be from 100°–200° C./ft., 200° C./ft.–400° C./ft. or greater than 400° C./ft.

Also, the magnitude of fluid pressure can be controlled to suit the specific application. For instance, the pressure vessel can be pressurized from 50–200 psi, 200–500 psi, at least 500 psi or over 1000 psi. Typically, the greater the fluid pressure, the greater the thermal gradient.

The thermal characteristics within the interior 13 of the pressure vessel 14 can be controlled in a variety of ways. For instance, as shown in FIG. 5, insulation 36 can be provided in the pressure vessel 14 about the mold 10. The insulation 36 can be added around specific areas of the mold 10 to selectively control heat extraction. It should be noted that a porous material which acts like an insulator at room pressure can become a conductor once the pressure vessel 14 is pressurized. The higher the pressures and pour size, the greater the increase in conduction. Thus, during the melting of the material 16, as shown in FIG. *2b*, a porous member can serve as insulation while during pressurization, the porous member can act as conductor. As shown in FIG. 8, the insulation 36 can be thicker around the top 20 of the mold 10 than around the bottom 22 of the mold 10.

Also shown in FIG. 5 is a chill member 38 for allowing increased extraction of heat from a specific area of the mold 10. The chill member 38 is preferably water cooled. Further, the walls 15 of the pressure vessel 14 can have water circulated therethrough to control wall temperature or to remove or add heat to the gas. Gas cooled from contact with the walls 15 drops and keeps the thermal gradient until the whole system is at the temperature of the walls 15. The insulation 36 and chill members 38 can be treated as modular components which can be added in, left out or replaced with heating elements 50 to modify the thermal gradient for each specific application.

As shown in FIG. 4, a grain starter 40 can be provided in thermal contact with the material 16 to induce single crystal growth within the material 16. The crystal grain starter 40 is in contact with the material 16 at point 42. By maintaining point 42 as the coldest point in contact with material 16, the material can be made to solidify from point 42. The solidification expands from the point 42 until the material is entirely solidified.

If, for example, the heating coils 26 are inductive heating coils having fluid circulating therethrough, they can be used both for heating and cooling. During heating, the inductive heating coils operate in their usual manner, providing inductive energy to the material 16 while being cooled internally with a circulating fluid, such as water. To cool the casting, fluid is circulated through the unenergized induction coils. In this manner, an induction heating coil can serve the dual purpose of a heat provider and a heat extractor and enhance the thermal gradient.

Figure 2A:
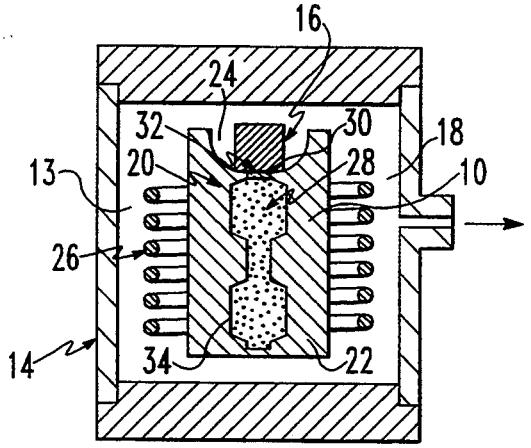
Figure 2B:
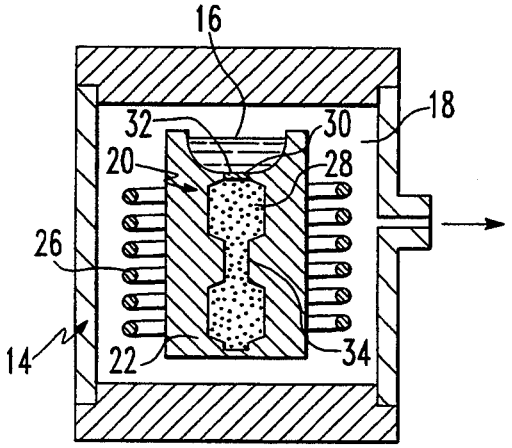
Figure 2C:
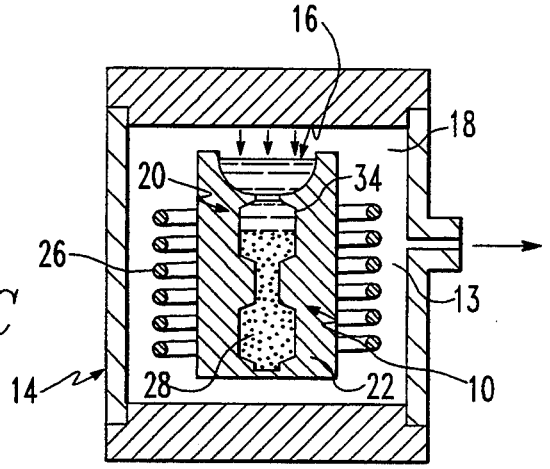
Figure 2D:
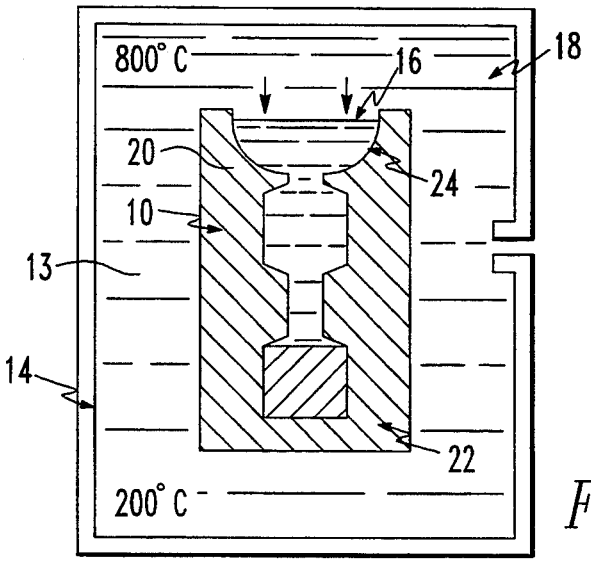
Figure 3A:
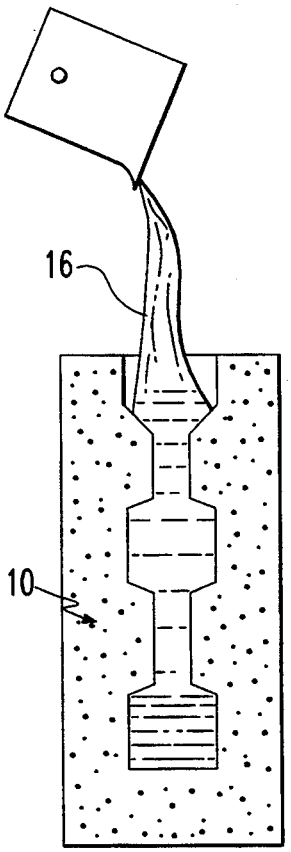
Figure 3B:
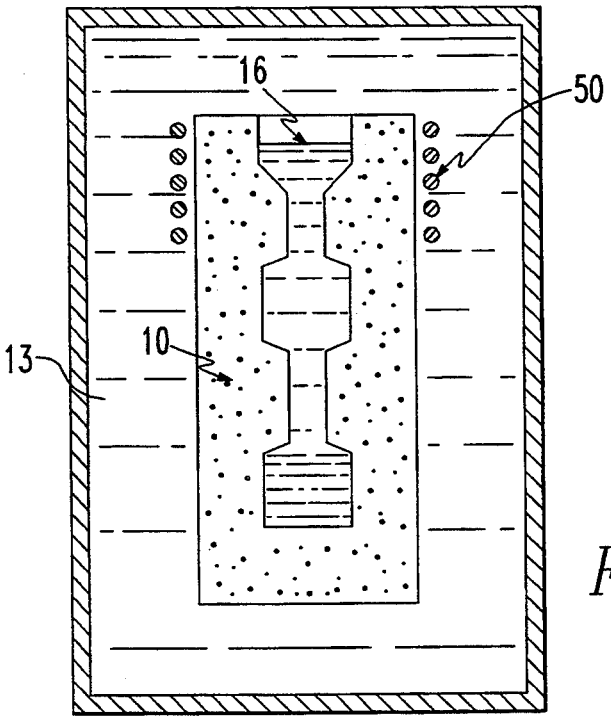

In one embodiment, and as shown in FIGS. 2*a*–2*d*, the step of introducing fluid into the pressure vessel 14 can serve the dual purpose of forcing the liquid material 16 into the mold chamber 34 and forming the thermal gradient. Further, the pressurized gas provides rapid cooling for faster production times. In this method, there is the step of disposing a mold 10 with a mold chamber 34 within an interior 13 of a pressure vessel 14, as shown in FIG. 2*a*. If desired, the mold chamber 34 can have reinforcement material 28 disposed therein. Then, there is the step of introducing fluid into the pressure vessel 14 such that the fluid forces a liquid material 16 to infiltrate the reinforcement material 28 and the fluid that initially enters the pressure vessel 14 is heated to a greater temperature than fluid subsequently introduced into the vessel 14 due to the fluid absorbing heat from the interior 13 of the vessel 14, as shown in FIG. 2*c*. The fluid at the greater temperature rises to the top 18 of the pressure vessel 14 and forces cooler fluid down so that a thermal gradient is formed in the vessel 14 such that the temperature of the fluid about the top 20 of the mold 10 allows material 16 within the top 20 of the mold 10 to remain at a higher temperature than the material within the bottom 22 of the mold to induce directional cooling of the material 22 in the mold 10 from the bottom 22 of the mold towards the top, as shown in FIG. 2*d*. Preferably the thermal gradient induces directional solidification.

It should be noted that with the present invention a thermal gradient is maintained within the pressure vessel 14 continually during the entire cooling process, until equilibrium at preferably room temperature is achieved.

It should also be noted that the rate of directional solidification can be controlled by altering many factors such as the rate of which the gas is introduced into the pressure vessel 14, the gas pressure, gas temperature, insulation, size of the vessel, temperature of vessel, pressure vessel wall temperature and heat exchangers, such as chill members or heating elements. In terms of pressurization rates, there is an optimal pressurization rate and pressure which produces the greatest thermal gradient across the mold 10. If the gas is introduced very slowly, the initial gas has time to become in thermal equilibrium with subsequent gas. Accordingly, the thermal gradient formed within the pressure vessel 14 and across the mold 10 is minimal. This is undesirable since the material 16 can solidify from various locations instead of being forced to solidify from a single direction. At pressures and pressurization rates below the optimum, the material 16 can still be directionally solidified and cooled but at a slower rate. Conversely, at pressures and pressurization rates above the optimum, directional solidification can occur too fast and stress or crack the part or parts by causing too large a gradient in the casting.

If desired, the gas can be recirculated throughout the pressure vessel 14 to reduce the thermal gradient during cooling. Also, hot gas can be removed from the top of the pressure vessel 14 through an inlet therefrom while adding more cooler gas into the pressure vessel. Further, gas pressure can be constantly increased during cooling of the material 16 through its liquid and solid phase for densifying the material 16.

The gas at the top of the pressure vessel 14 is hotter than the gas at the bottom of the pressure vessel 14, though both have equal pressure. Accordingly, as defined by Boyle's law, the density of the gas at the bottom of the pressure vessel 14 is greater than the density of the gas at the top 18 of the pressure vessel 14 where the molecules of the gas are hotter and thus moving faster than at the bottom of the vessel. This is beneficial to the described directional solidification process and cooling, since the rate of heat transfer between the gas and the material 16 is proportional to the density of the gas. Thus, more heat transfer occurs at the lower part of the mold 10 where it is desired to effect cooling and consequently directional solidification and cooling. If desired, the gas can be reactive with the material 16. Also, liquid can be used as the fluid rather than gas.

In the operation of one embodiment of the invention, and as shown in FIGS. 2*a*–2*d*, aluminum 16 is placed within a melt chamber 24 of an investment mold 10 or permanent mold, as shown in FIG. 2*a*. The chamber 16 is in fluidic communication with the mold cavity 34 of the mold 10 through a passage 30 containing a ceramic filter 32. The mold cavity 34 has a preform of SiC reinforcement material 28 disposed within it. The pressure vessel 14 is then fluidically sealed and evacuated. An inductive heating coil or resistant element 26 is activated and melts the aluminum 16 such that it fluidically seals the passage 30 as shown in FIG. 2*b*. The filter 32 prevents the aluminum from entering the mold 10. The heating coil 26 is then turned off so no further externally supplied heat is provided to the interior 13 of the pressure vessel. (Alternatively, as shown in FIG. 1, a heating element 50 disposed about the top 20 of the mold can provide heat only to the top 20 of the mold 10.)

The pressure in the vessel 14 is then increased with the introduction of nitrogen gas which is at room temperature or below. The pressurized nitrogen forces the aluminum 16 through the filter 32 and into the chamber 34 of the mold 10. The aluminum 16 infiltrates the preform 28 disposed in the mold 10. The nitrogen gas that first enters the pressure vessel 14 to pressurize it is heated by the melted aluminum 16, mold 10 and the interior 13 of the pressure vessel 14. As further gas is introduced into the pressure vessel 14, it is at a cooler temperature than the gas that has already been heated. As the pressure is increased due to more gas entering the vessel 14, the melted aluminum 16 infiltrates into the preform 28. The heated gas already in the pressure vessel 14 rises as the cooler gas is introduced into the vessel 14 to continue to raise the pressure therein. Through this procedure, for instance, a final pressure of 1000 PSI in the pressure vessel 14 creates a gradient of 600° C. between the top and bottom of the pressure vessel 14, which is approximately 12 inches in length. The cooler gas which collects at the bottom of the vessel 14 causes directional solidification to occur in the aluminum 16 at the bottom 22 of the mold 10. As the hotter gas at the top of the pressure vessel 14 cools, the solidification front proceeds upwards until the aluminum 16 is entirely solidified. The entire pressurization cycle can take less than one minute or up to 30 minutes and beyond, depending on the application. The gas can be recirculated through the pressure vessel 14 to reduce the thermal gradient. The newly formed composite part is then removed from the mold for subsequent. finishing processes or put into use.

In a more preferred embodiment, the liquid metal 16, such as nickel alloy, is poured in an investment mold 10 to form a shape. The pouring can take place in the pressure vessel 14 or remote therefrom. When the mold 10 with metal therein is in the pressure vessel 14, the vessel 14 is pressurized with gas which in turn induces a thermal gradient as previously described. In this embodiment, there is no preform. The gas is not used to force metal into a reinforcement, but for directional solidification purposes.

FIG. 7 shows an aluminum casting chart showing the pressurization curve and the resulting temperature curves at various location within the interior 13 of the pressure vessel. The location of $T_1$, $T_2$, $T_3$, $T_4$, $T_5$ and $T_6$ is shown in FIG. 1. FIG. 6 shows a typical casting chart for iron.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A method of direction cooling comprising the steps of:

positioning material in a liquid state within a chamber; and providing pressurized fluid about the chamber to form a thermal gradient of desired degree across the chamber to directionally solidify the material within.

2. A method as described in claim 1 wherein the providing step includes the step of forming a thermal gradient between a top of the chamber and a bottom of the chamber with a higher fluid temperature on top than on bottom.

3. A method as described in claim 2 wherein the positioning step includes the step of disposing a mold with a mold chamber having material in a liquid state in the mold chamber within an interior of a pressure vessel and the providing step includes the step of introducing fluid into the pressure vessel such that fluid that initially enters the pressure vessel is heated to a greater temperature than fluid subsequently introduced into the vessel due to absorbing heat from the interior of the vessel, said fluid at the greater temperature rising to the top of the pressure vessel and forcing cooler fluid down so that a thermal gradient is formed in the pressure vessel such that the temperature of the fluid about the top of the mold allows the material within the top of the mold to remain at a higher temperature than the material within the bottom of the mold to induce directional cooling of the material in the mold from the bottom of the mold towards the top.

4. A method as described in claim 3 wherein the introducing step creates a condition for directionally solidifying the material.

5. A method as described in claim 4 wherein the disposing step includes the step of loading a mold having material in a liquid stage into the interior of the pressure vessel.

6. A method as described in claim 5 wherein before the step of introducing fluid, there is the step of evacuating the interior of the pressure vessel.

7. A method as described in claim 6 wherein after the disposing step, there is the step of heating the top of the mold.

8. A method as described in claim 3 wherein the disposing step includes the steps of placing the material and mold within the pressure vessel and heating the material causing it to be liquid.

9. A method as described in claim 8 wherein before the introducing step, there is the step of evacuating the interior of the pressure vessel.

10. A method as described in claim 9 wherein before the introducing step, there is the step of stopping the heat to the material.

11. A method as described in claim 9 wherein during the introducing step, there is the step of heating only the top of the mold.

12. A method as described in claim 1 wherein the fluid is comprised of gas.

13. A method as described in claim 12 wherein the gas is comprised of inert gas.

14. A method as described in claim 13 wherein the fluid is comprised of nitrogen.

15. A method as described in claim 13 wherein the fluid is comprised of argon.

16. A method as described in claim 12 wherein the gas is comprised of a gas reactive with the material.

17. A method as described in claim 1 wherein the fluid is comprised of a liquid.

18. A method as described in claim 1 wherein the material is comprised of metal.

19. A method as described in claim 1 wherein the material is comprised of plastic.

20. A method as described in claim 1 wherein the material is comprised of ceramic.

21. A method as described in claim 3 wherein the mold is comprised of an investment mold.

22. A method as described in claim 3 wherein the mold is a permanent mold.

23. A method as described in claim 3 wherein the step of introducing fluid into the pressure vessel is such that the thermal gradient is between 100° C./ft. and 200° C./ft.

24. A method as described in claim 3 wherein the step of introducing fluid into the pressure vessel is such that the thermal gradient is between 200° C./ft. and 400° C./ft.

25. A method as described in claim 3 wherein the step of introducing fluid into the pressure vessel is such that the thermal gradient is over 400° C./ft.

26. A method as described in claim 3 wherein the introducing fluid into the pressure vessel step includes the step of pressurizing the pressure vessel to 50–200 psi.

27. A method as described in claim 3 wherein the introducing fluid into the pressure vessel step includes the step of pressurizing the pressure vessel to 200–500 psi.

28. A method as described in claim 3 wherein the introducing fluid into the pressure vessel step includes the step of pressurizing the pressure vessel to at least 500 psi.

29. A method as described in claim 3 wherein the introducing fluid into the pressure vessel step includes the step of pressurizing the pressure vessel to at least 1000 psi.

30. A method as described in claim 3 including the step of controlling heat transfer from the material in the mold with insulation disposed within the pressure vessel.

31. A method as described in claim 30 wherein the insulation has a first thickness adjacent to the top of the mold and a second thickness which is less than the first thickness about the bottom of the mold.

32. A method as described in claim 3 including the step of controlling heat transfer from the material in the mold with a chill member adjacent to the mold.

33. A method as described in claim 32 wherein the controlling step includes the step of circulating a fluid through a chill member which is adjacent with a portion of the mold to extract heat from said portion of the mold.

34. A method as described in claim 3 including the step of establishing single crystal growth with a grain starter which is disposed in the bottom of the mold.

35. A method as described in claim 3 including the step of circulating a fluid through the walls of the pressure vessel.

36. A method as described in claim 3 including the step of circulating fluid through an induction coil disposed within the pressure vessel to cool the material within the mold.

37. A method as described in claim 3 including, there is the step of recirculating the fluid within the pressure vessel to reduce or increase the thermal gradient.

38. A method as described in claim 3 wherein the introducing step includes the step of removing hot fluid from the top of the pressure vessel while adding more fluid into the pressure vessel.

39. A method of casting comprising the steps of:

positioning a mold with a mold chamber, having reinforcement material in the mold chamber, within an interior of a pressure vessel;

introducing fluid into the pressure vessel such that the fluid forces a liquid material to infiltrate the reinforcement material and the fluid that initially enters the pressure vessel is heated to a greater temperature than fluid subsequently introduced into the vessel due to the fluid absorbing heat from the interior of the vessel, said fluid at a greater temperature rising to the top of the pressure vessel and forcing cooler fluid down so that a thermal gradient of desired degree is formed in the vessel such that the temperature of the fluid about the top of the mold allows the material within the top of the mold to remain at a higher temperature than the material within the bottom of the mold to induce directionally solidifying of the material in the mold from the bottom of the mold.

40. A method as described in claim 39 wherein before the introducing step, there is the step of evacuating the interior of the pressure vessel.

41. A method as described in claim 40 wherein the directionally solidifying step includes the step of controlling the pressure of the fluid such that the material is densified through its liquid and solid phases.

* * * * *